US005499426A

United States Patent [19]

Hsieh

[11] Patent Number: 5,499,426

[45] Date of Patent: Mar. 19, 1996

[54] RETRACTABLE HANDLE DEVICE FOR A WHEELED SUITCASE

[76] Inventor: Dick M. Hsieh, No.18, Lane 777, Chung-Shan Rd., Kuei-Jen Hsiang, Tainan Hsien, Taiwan

[21] Appl. No.: 235,667

[22] Filed: Apr. 29, 1994

[51] Int. Cl.[6] ..... B25G 1/04

[52] U.S. Cl. ..... 16/115; 280/655

[58] Field of Search ..... 16/115, 111 R, 16/DIG. 38; 280/47.315, 655, 655.1; 190/14, 15 R, 104, 18 R, 18 A

[56] References Cited

U.S. PATENT DOCUMENTS

| | | | |
|---|---|---|---|
| 3,702,016 | 11/1972 | Keesee | 16/111 A |
| 4,974,871 | 12/1990 | Mao | 280/655 |
| 5,355,980 | 10/1994 | Hsieh | 190/18 A |

*Primary Examiner*—P. Austin Bradley
*Assistant Examiner*—Chuck Y. Mah
*Attorney, Agent, or Firm*—Ladas & Parry

[57] ABSTRACT

A handle device includes a pair of storage tubes adapted to be mounted on a rear face of a wheeled suitcase, a seat frame, a handle member and a locking mechanism. Each storage tube has a top open end and a first engaging hole adjacent to the top open end. The seat frame is fastened to and extends between the storage tubes. The handle member has two arm portions which are inserted slidingly into the storage tubes and which are provided with at least one second engaging hole. The seat frame confines a receiving space which is communicated with the first engaging holes of the storage tube. The locking mechanism is provided in the receiving space of the seat frame and includes two projecting members, a biasing unit between the projecting members for biasing the projection members toward the storages tubes and for locking the handle member relative to the storage tubes when the two engaging holes are in alignment, and a retracting unit for retracting the projecting members to release the handle member relative to the storage tubes.

4 Claims, 7 Drawing Sheets

RETRACTABLE HANDLE DEVICE FOR A WHEELED SUITCASE

BACKGROUND OF THE INVENTION

1. FIELD OF THE INVENTION

The invention relates to a handle device, more particularly a retractable handle device for a wheeled suitcase.

2. DESCRIPTION OF THE RELATED ART

Referring to FIG. 1, a conventional retractable handle device (B) is shown to be mounted on a rear surface (C) of a wheeled suitcase (A). As best illustrated in FIGS. 2 and 3, the conventional retractable handle device (B) includes a pair of storage tubes 50, a handle member 51, a hollow seat frame 20 and a locking mechanism.

Each of the storage tubes 50 is mounted on the rear surface (C) of the wheeled suitcase (A) and has a top open end 501 and a first engaging hole 500 adjacent to the top open end 501. The hollow seat frame 20 has two opposite end portions 24 fastened to the storage tubes 50 and extends therebetween adjacent to the top open ends 501 of the latter. The hollow seat frame 20 confines a receiving space 201 therein which is communicated with an interior of a respective one of the storage tubes 50 via the first engaging hole 500. The seat frame 20 has a substantially flat top wall 21 formed with two through-holes 22 and two internally threaded posts 23 that extend downwardly into the receiving space 201.

The handle member 51 is U-shaped and has two parallel arm portions 510 that are inserted slidingly into the storage tubes 50 via the top open ends 501. Each of the arm portions 510 is provided with a second engaging hole 511 adjacent to its lowermost portion and aligned and communicated with a respective one of the first engaging holes 500 of the storage tubes 50 when the arm portions 510 are moved to a certain position with respect to the storage tubes 50.

The locking mechanism is constituted by a slide member 30, a holding seat 40, a push knob 10 and two biasing spring sets. Each of the biasing spring sets includes a spring member 513 provided within a respective one of the arm portions 510 and has a first end welded to the arm portion 510 adjacent to its lowermost end portion, and a curved projection 512 which is biased by a second end of the spring member 513 so that the curved projection 512 extends into the second engaging hole 500 of the respective one of the arm portions 510. The curved projection 512 extends into the first engaging hole 500 of the storage tube 50 when the latter is aligned with the second engaging hole 511 in order to lock the handle member 51 relative to the storage tubes 50.

The holding seat 40 includes an elongated plate 410 mounted to the hollow seat frame 20 at a lowermost portion thereof. The elongated plate 410 has a spring retaining post 41 which extends upwardly and centrally therefrom and a pair of vertical insert posts 42 disposed on both sides of the spring retaining post 41 and aligned respectively with the threaded posts 23 of the top wall 21. A compression spring 411 is sleeved around the spring retaining post 41. The slide member 30 is disposed on the elongated plate 410 and includes two opposite curved end portions 34 which abut against the external surfaces of the storage tubes 50 and an elongated bottom plate 301 which extends between the two curved end portions 34. Each of the curved end portions 34 is further provided with a recess 340, the purpose of which will be described in greater detail in the following paragraphs. The bottom plate 301 of the slide member 30 has a central hole 31 aligned with the spring retaining post 41 of the elongated plate 410, two retaining holes 32 formed on both sides of the central hole 31 and aligned respectively with the through holes 22 of the top wall 21, and a pair of mounting holes 33 aligned respectively with the insert posts 42 of the elongated plate 410. The spring retaining post 41 and the insert posts 42 of the holding frame 40 extend respectively through the central hole 31 and the mounting holes 33 of the slide member 30. A pair of locking screws 45 extend through the holding frame 40 and the slide member 30 and are threaded to the posts 23. The holding seat 40 is thus fastened securely to the seat frame 20. Under such a condition, the compression spring 411 biases the slide member 30 and disposes the latter adjacent to the top flat wall 21 of the seat frame 20 to align the curved recesses 340 on the curved end portions 34 of the slide member 30 with the first engaging holes 500 in the storage tube 50 so that the curved projection 512 extend into the curved recesses 340 via the first engaging holes 500 of the storage tubes 50 when the engaging holes 500, 511 are in alignment with each other. The push knob 10 includes two parallel connecting arms portions 12 with internally threaded distal end portions inserted through the through-holes 22 of the flat top wall 21 and threaded by two screws 35 that pass through the retaining holes 32 of the slide member 30.

In order to release the handle member 51 from the locked position, the push knob 10 is pressed downwardly to compress the slide member 30 correspondingly. Downward movement of the slide member 30 pushes the curved projections 512 against the biasing action of the spring members 513 to disengage the first and second engaging holes 500, 511 of the storage tubes 50 and the arm portions 510, thus permitting pushing of the handle member 51 inwardly for storage within the storage tubes 50.

Some of the drawbacks that result from the use of the conventional retractable handle device are as follows:

(I) It is difficult to weld the spring member within the parallel arm portions 510 of the handle member 51, since the parallel arm portions 510 are formed by tubes with relatively small diameters.

(II) The handle member 51 cannot be extended at a desired length because there is only one spring member mounted in each of the arm portions 510 therein. In order to permit retention of the handle member 51 at different lengths, a plurality of biasing spring sets must be mounted in the arm portions 510 of the handle member 51, thereby increasing the manufacturing costs incurred.

SUMMARY OF THE INVENTION

A main objective of the present invention is to provide a retractable handle device for a wheeled suitcase which includes a seat frame with a locking mechanism that can be assembled easily.

A second objective of the present invention is to provide a retractable handle device which includes a handle member that can be retained at different lengths.

Accordingly, the retractable handle device of the present invention includes a pair of parallel storage tubes, a hollow seat frame, a handle member and a locking mechanism. Each of the parallel storage tubes is to be mounted on the body of a wheeled suitcase and has a top open end and a first engaging hole adjacent to the top open end. The hollow seat frame has two opposite end portions fastened to the storage tubes so as to extend therebetween adjacent to the top open ends the latter. The seat frame confines a receiving space therein which is communicated with the first engaging holes of the storage tubes. The handle member includes two parallel arm portions inserted slidingly and axially into the storage tubes via the top open ends the latter. Each of the arm portions has at least one second engaging hole which is to be aligned and communicated with a respective one of the first engaging holes of the storage tubes when the handle member is extended from the seat frame at a predetermined length. The locking mechanism is provided in the receiving space of the hollow seat frame and includes two projecting members with a biasing means therebetween to bias the projecting members to extend into the first and second engaging holes of the storage tubes and the parallel arm portions of the handle member when the first and second engaging holes are in alignment with one another, thus locking the handle member relative to the storage tubes. The locking mechanism further includes means for retracting the projecting members against biasing action of the biasing means from the first and second engaging holes of the storage tubes and the arm portions of the handle member, thereby permitting the release of the handle member from the storage tubes.

In the disclosed embodiment, all of the components of the locking mechanism are mounted in the receiving space of the seat frame between the storage tubes without any difficulty, thus facilitating the assembly thereof. Since the arm portions of the handle member are provided with a plurality of spaced second engaging holes which are aligned axially with one another and which are communicated selectively with the first engaging holes of the storage tubes, the handle member can thus be extended from the seat frame and fixed at more than one position.

BRIEF DESCRIPTION OF THE DRAWINGS

Other features and advantages of the present invention will become more apparent in the following detailed description of the preferred embodiment, with reference to the accompanying drawings, in which.

DETAILED DESCRIPTION OF THE PREFERRED EMBODIMENT

Figure 1:
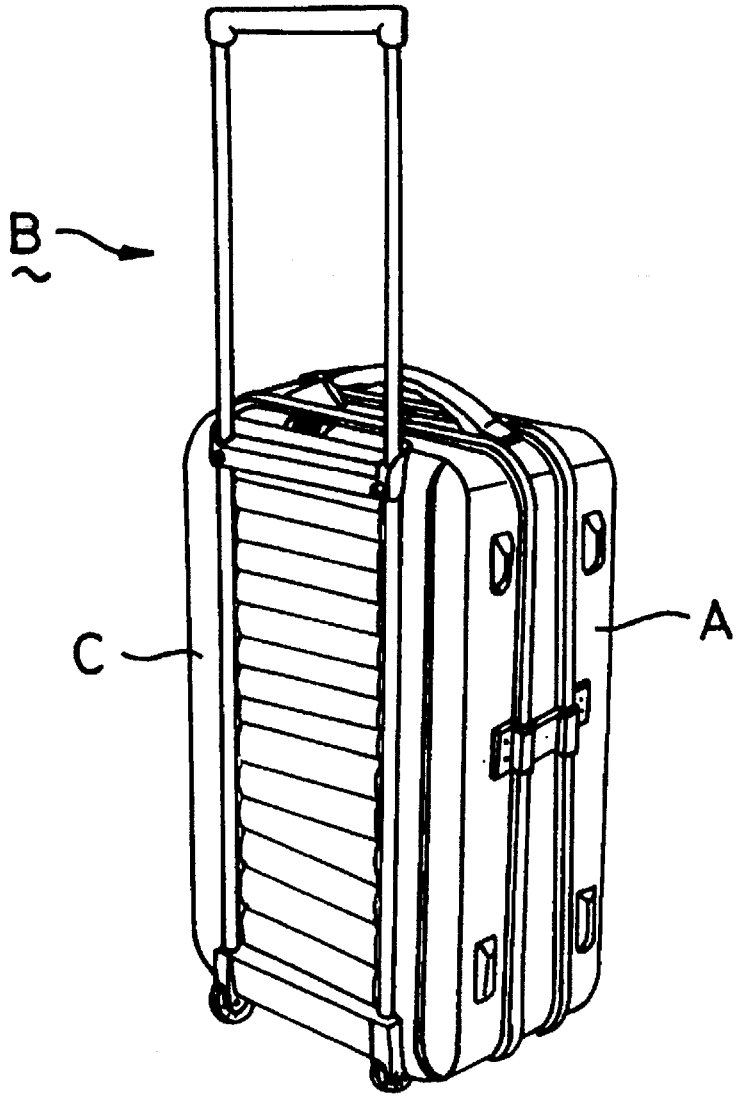
FIG. 1 (PRIOR ART)
FIG. 1 shows a conventional retractable handle device mounted on a wheeled suitcase.
Figure 2:
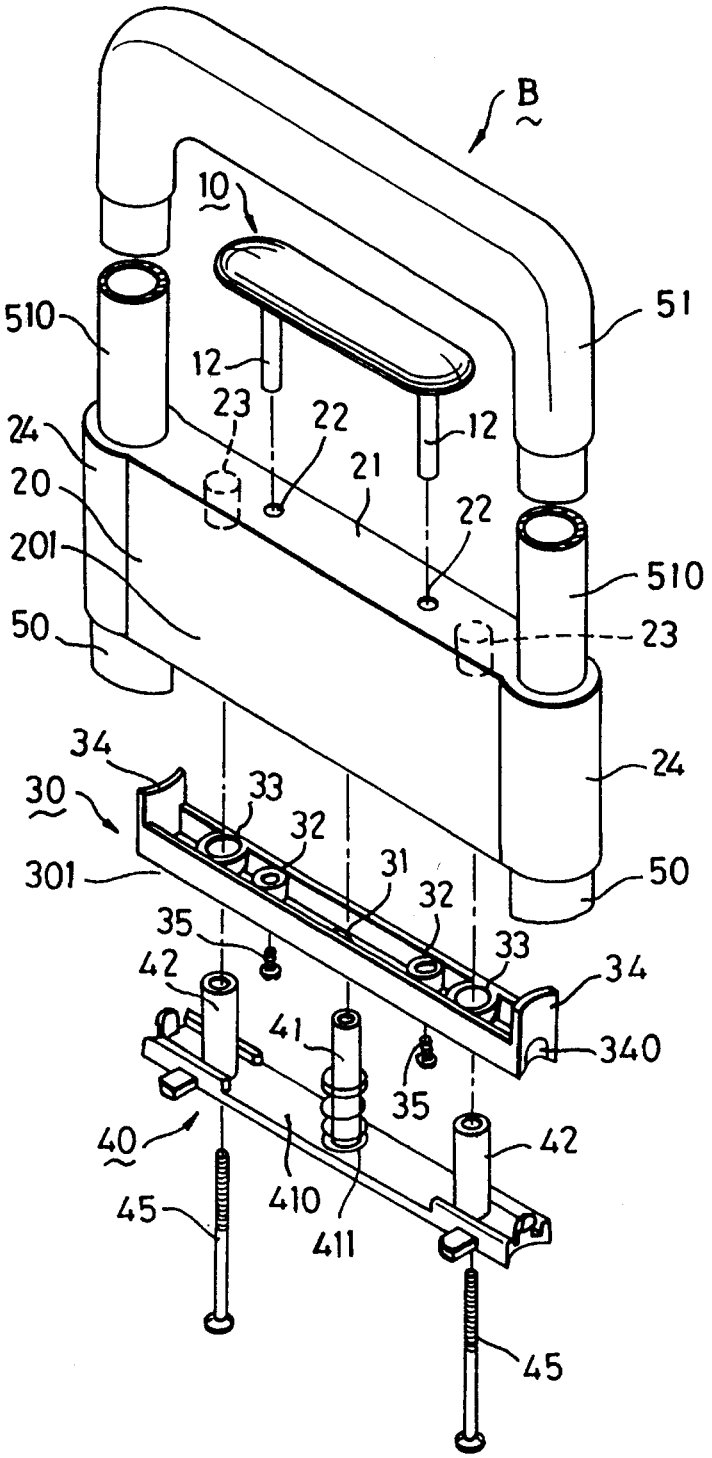
FIG. 2 (PRIOR ART)
FIG. 2 shows an exploded, schematic view of the conventional retractable handle device.
Figure 3:
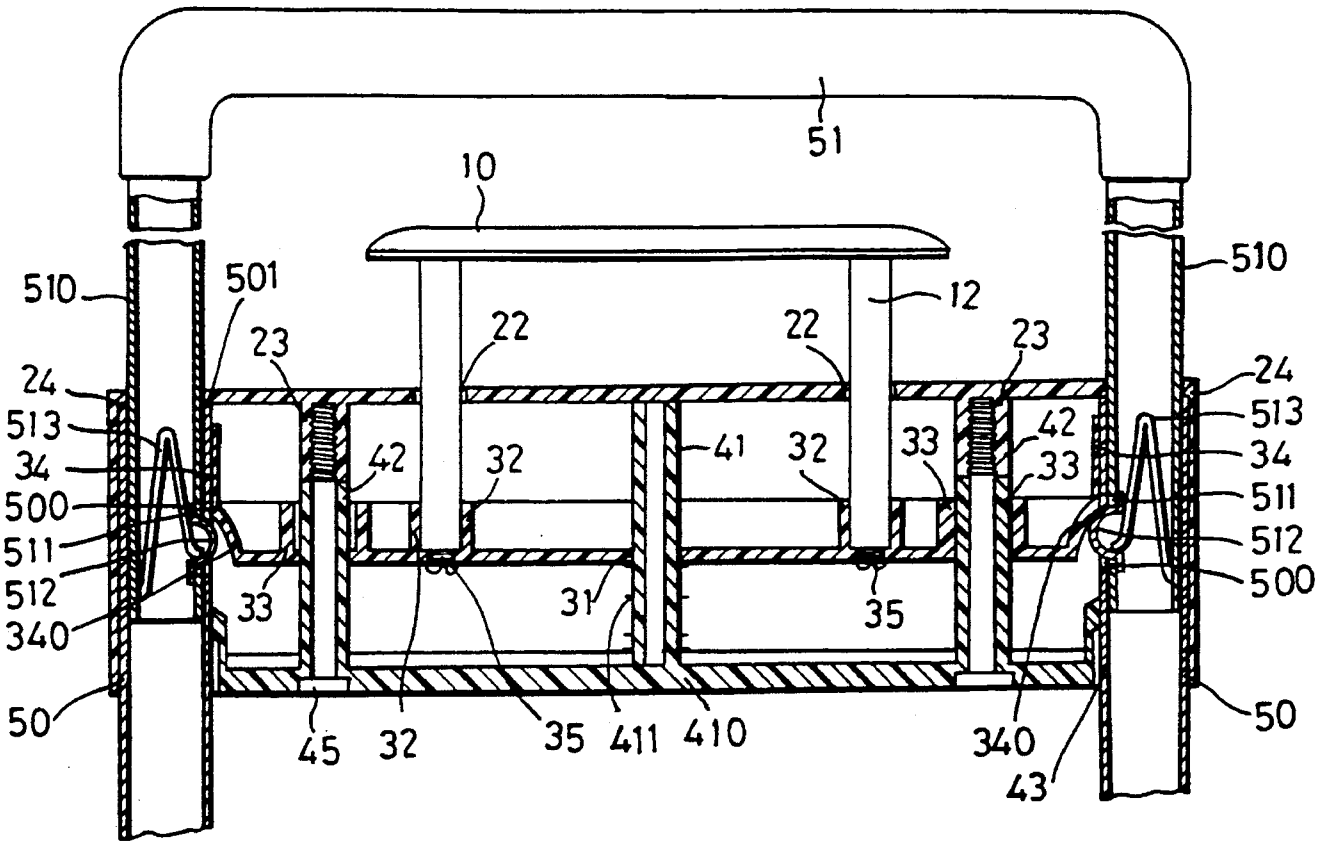
FIG. 3 (PRIOR ART)
FIG. 3 shows a cross sectional view of the conventional retractable handle device, the handle member being illustrated at an extended and locked position.
Figure 4:
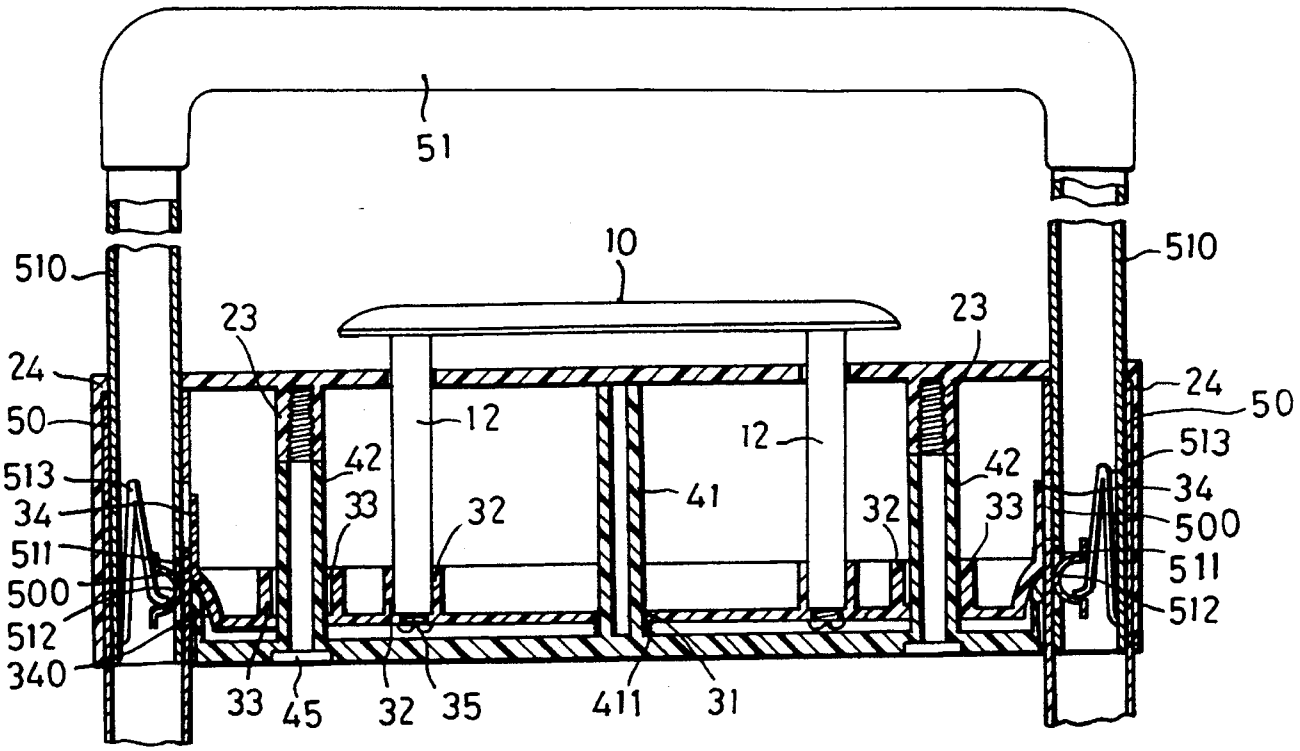
FIG. 4 (PRIOR ART)
FIG. 4 shows a cross sectional view of the conventional retractable handle device, the handle member being illustrated at a released position.
Figure 5:
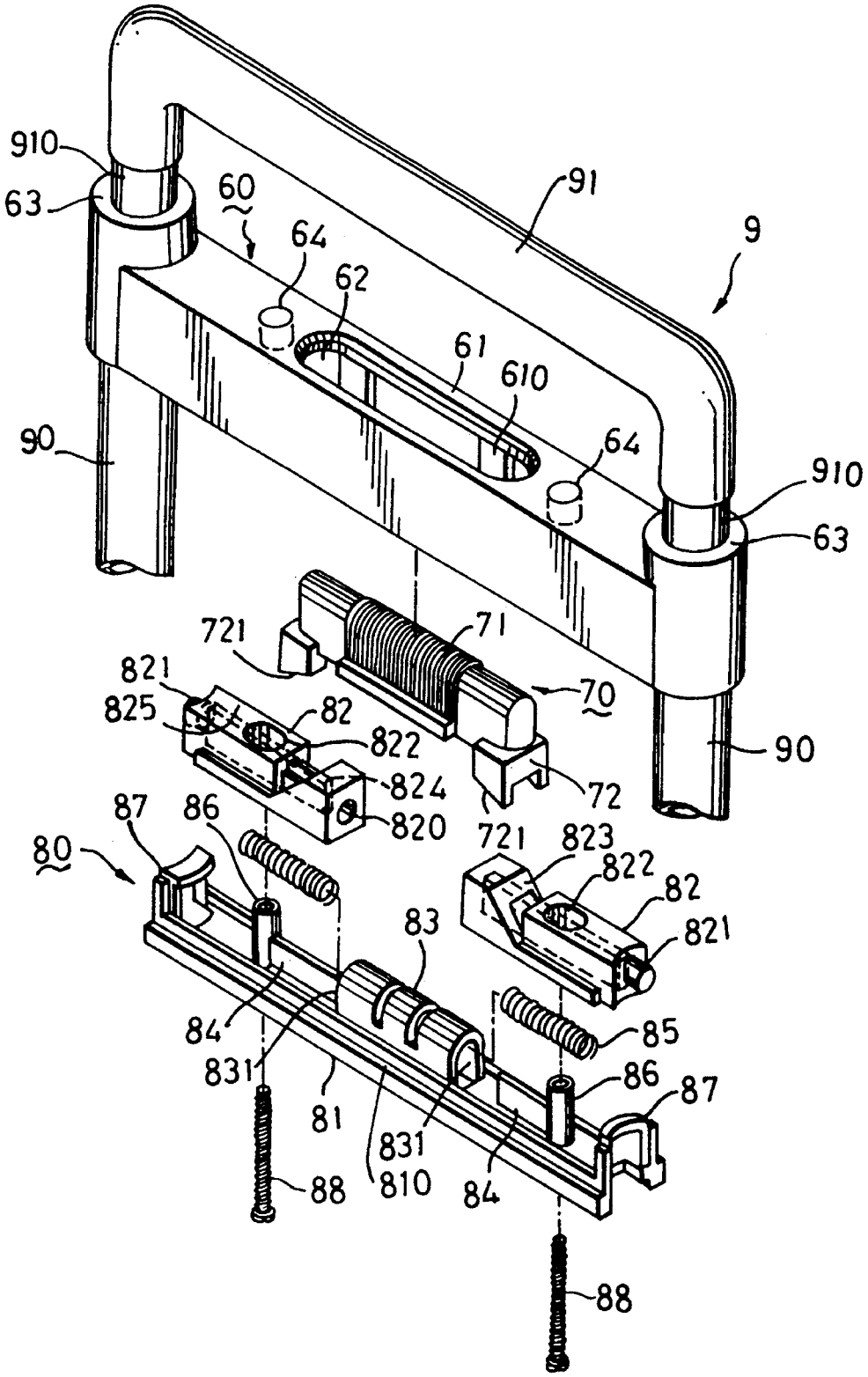
FIG. 5 shows an exploded, schematic view of a retractable handle device of the present invention.
Figure 6:
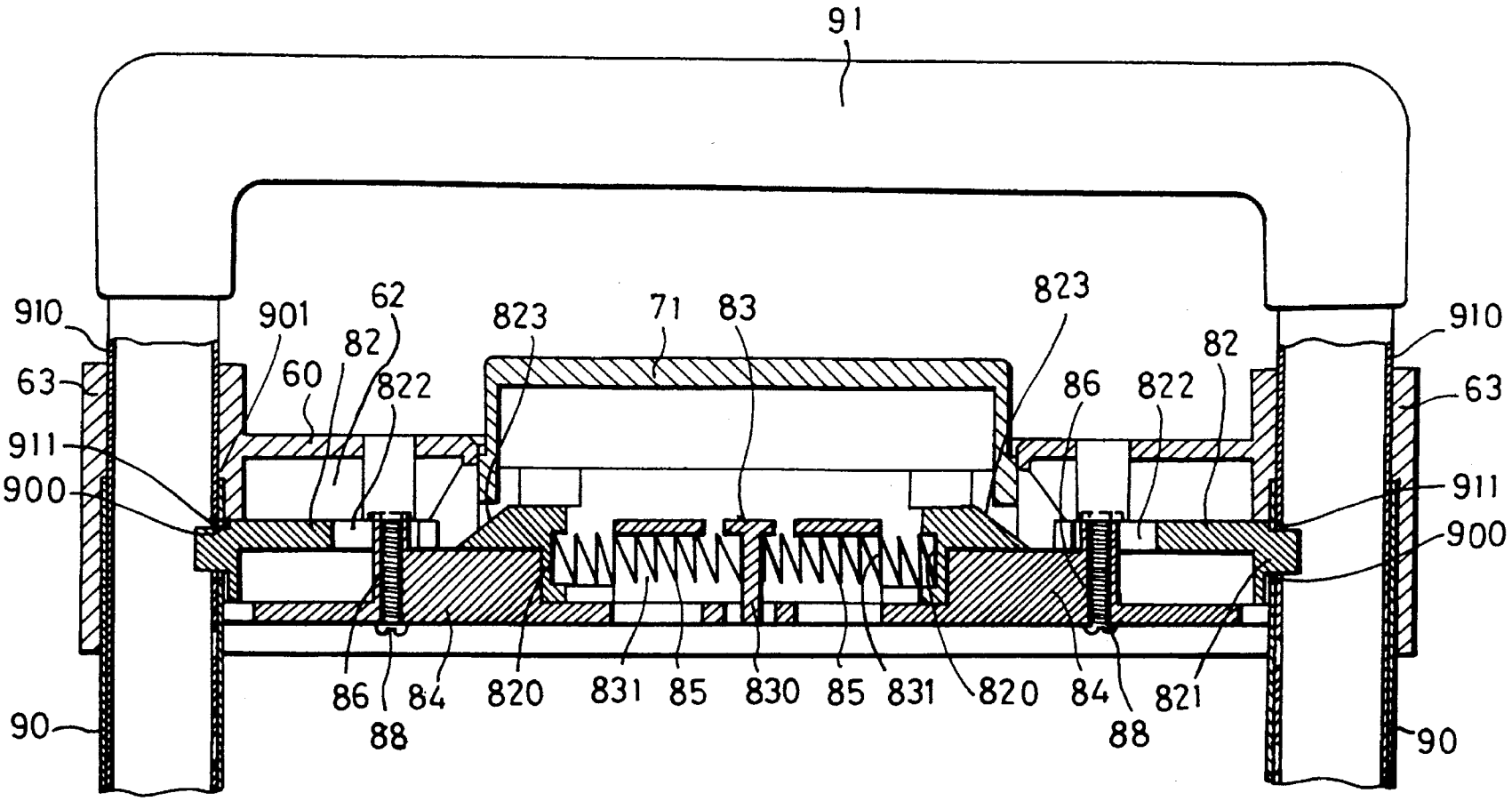
FIG. 6 shows a partially cross sectional view of the retractable handle device of the present invention, illustrating the handle member at a retracted and locked position.
Figure 7:
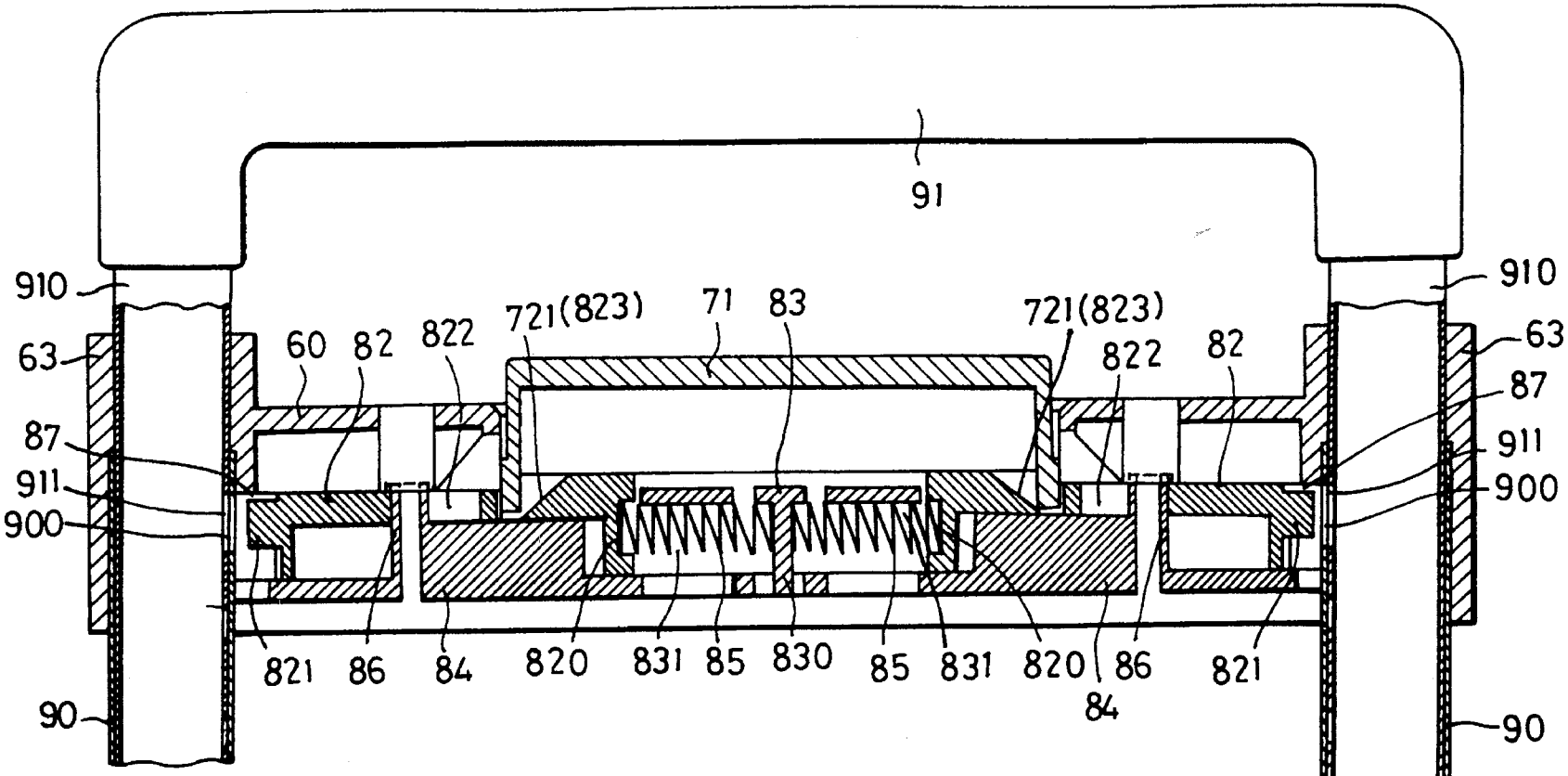
FIG. 7 shows a partially cross sectional view of the retractable handle device of the present invention, illustrating the handle member at a released position.

Referring to FIGS. 5 and 6, a retractable handle device of the present invention is shown to comprise a pair of storage tubes 90, a hollow seat frame 60, a handle member 9 and a locking mechanism.

Each of the storage tubes 90 is adapted to be mounted on a rear surface of a wheeled suitcase (not shown) and has a top open end 901 and a first engaging hole 900 adjacent to the top open end 901. The first engaging holes 900 of the storage tubes 90 face to one another and are in alignment.

The hollow seat frame 60 is formed as one-piece molded unit in a conventional manner, such as by cast molding, and has a flat top wall 61 with an opening 610 formed therethrough. The seat frame 60 further has two opposite end portions 63 fastened securely to the storage tubes 90 in any suitable manner so as to extend between the top open ends 901 of the latter. The hollow seat 60 confines a receiving space 62 therein which is communicated with an interior of the storage tubes 90 via the first engaging holes 900.

The handle member 9 is U-shaped and has two parallel arm portions 910 and a transverse pull member 91 that interconnects the parallel arm portions 910. The parallel arm portions 910 are inserted slidingly and axially into the storage tubes 90 via the top open ends 901 of the latter and are each formed with a plurality of spaced aligned second engaging holes 911 which can be aligned selectively with a respective one of the first engaging holes 900 of the storage tubes 90.

The locking mechanism is provided in the receiving space 62 of the seat frame 60 and includes a pair of projecting members 82, a biasing means, a member holding frame 80 and a retracting means 70. The projecting-member holding frame 80 has two opposite end portions 87 abutting against the external surfaces of the respective storage tube 90 and an elongated plate 81 which extends between the opposite end portions 87 and which is provided with a mounting face 810 that faces the flat top face 61 of the seat frame 60. The mounting face 810 of the elongated plate 81 has two spaced and aligned guiding rails 84 formed longitudinally thereon and a pair of hollow limiting posts 86 formed integrally with the guiding rails 84, the purposes of which will be described in greater detail in the following paragraphs.

The projecting members 82 are provided on the mounting face 810 of the elongated plate 81. Each of the projecting members 82 has a front end provided with an engaging protrusion 821, a rear end provided with a receiving recess 820. Each of the projecting members 82 is a longitudinal body with a length parallel to the flat top wall 61 of the seat frame 60 and has a top face 825 which is provided integrally with an inclined surface 823 that extends downwardly and frontwardly from a position adjacent to the rear end towards the front end of thereof. Each of the projecting members 82 further has an elongated hole 822 which permits the limiting post 86 of the holding frame 80 to extend therethrough and an elongated groove 824 that permits the guiding rail 84 to extend thereinto so that the projecting member 82 rides slidingly on the guiding rail 84. A pair of locking bolts 88 extend through the limiting posts 86 of the holding frame 80 and are threaded to the threaded posts 64 of the top wall 61. Note that the elongated hole 822 of the projecting member 82 is sufficient to permit relative movement of the projecting member 82 after the assembly thereof.

The biasing means includes an elongated spring retaining enclosure 83 which has two opposite open ends 831 which is formed longitudinally on the mounting face 810 of the elongated plate 81 between and in alignment with the guiding rails 84. The spring enclosure 83 has a partition 830 formed transversely therein to divide the same into two parts. Each of a pair of compression springs 85 has a first end portion provided in a respective one of the parts and a second end portion received by the receiving recess 820 of the respective projecting member 82 so that the respective projecting member 82 is biased toward one of the storage tubes 90. Under such a condition, the engaging protrusion 821 of the projection members 82 can extend and engage the first engaging holes 900 and a respective one of the second engaging holes 911 when the latter is aligned with the former.

The retracting means 70 of the present invention includes an elongated push knob 71 inserted into the seat frame 60 via the opening 610 in the flat top wall 61. The elongated push knob 71 has an upper portion which protrudes out of the seat frame 60 via the opening 610 of the top wall 61 and a lower portion with two sliding pieces 72, each of which is provided with a sliding face 721 that complements the inclined surface 823 of the respective projecting member 82. The sliding faces 721 of the push knob 71 are disposed on the inclined surface 823 of the projecting member 82. Under such a condition, the sliding pieces 72 of the push knob 71 are prevented from disengaging the seat frame 60. Vertical movement of the push knob 71 is converted into horizontal movement of the projecting members 82. Thus, when it is desired to unlock the handle member 9, the push knob 71 is compressed downward on the inclined surfaces 823 of the projecting members 82 against the actions of the compression springs 85 so that the projecting members 82 retract inward to disengage the engaging protrusions 821 from the storage tubes 90 and the arm portion 910. The handle member 9 can be pulled out or retracted interiorly according to the user's desire.

From the above explanation, one can clearly note that the locking mechanism for locking or releasing the handle member 9 relative to the storage tube 90 can be mounted in the hollow seat frame 60 easily, thereby facilitating the assembly of the retractable handle device of the present invention.

Since the second engaging holes 911, which are formed axially of the arm portions 910 of the handle member 9, can be aligned selectively with the first engaging holes 900 of the storage tubes 90, the handle member 9 can be extended at different lengths. Thus, the handle member 9 can be used by individuals of different heights.

While a preferred embodiment has been described and explained, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. A retractable handle device for a wheeled suitcase, comprising:

a pair of parallel storage tubes adapted to be mounted on said wheeled suitcase, wherein each of said storage tubes has a top open end and a bottom open end, and a first engaging hole formed adjacent said top open end and facing radially toward the other remaining tube;

a hollow seat frame extending between said storage tubes adjacent to said open ends and having two opposite end portions fastened respectively to said storage tubes, said hollow seat frame confining a receiving space therein which communicates with said first engaging holes, said hollow seat frame having a substantially flat top wall;

a handle member with two parallel arm portions inserted slidingly and axially into said storage tubes via said top open ends, each of said arm portions being provided with at least one second engaging hole to be aligned and communicated with a respective one of said first engaging holes;

a locking mechanism provided in said receiving space of said hollow seat frame and having two projecting members with a biasing means therebetween for biasing said projecting members to extend into said first engaging holes and said second engaging holes when said second engaging holes are in alignment with said first engaging holes so as to lock said handle member relative to said storage tubes, said locking mechanism including a holding frame fastened to said hollow seat frame and extending between said storage tubes, said holding frame having a mounting face which faces said flat top wall and which is provided with two spaced and aligned guiding rails that extend along a length thereof, said projecting members being guided respectively by said guiding rails; and means for operably retracting said projecting members against action of said biasing means to release said handle member relative to said storage tubes.

2. The retractable handle device as defined in claim 1, wherein said biasing means includes an elongated spring enclosure which has two opposed open ends and which is formed on said mounting face of said holding frame between and in alignment with said guiding rails, said spring enclosure having a partition formed transversely therein and dividing said spring enclosure into two parts, and a pair of compression springs, each of which having a first end portion provided in a respective one of said parts and a second end portion which biases a respective one of said projecting members.

3. The retractable handle device as defined in claim 2, wherein said top wall of said hollow seat frame has an opening formed therethrough, each of said projecting members having a longitudinal body with a length parallel to said top wall of said hollow seat frame, a front end with an engaging protrusion projecting axially therefrom and extending into a respective one of said first engaging holes of said storage tubes, a rear end opposite to said front end, and a top face extending between said front and rear ends and being formed integrally with an inclined surface that extends downwardly and frontwardly from a position adjacent to said rear end towards said first end of said projecting member, said retracting means including a push knob inserted movably into said seat frame via from said opening of said top wall, said push knob having a lower portion which is provided with a pair of sliding faces complementing and being disposed on said inclined surfaces of said projecting members and an upper portion exposed exteriorly of said seat frame.

4. The retractable handle device as defined in claim 1, wherein each of said arm portions in said handle member has a plurality of said second engaging holes which are aligned axially with one another.

* * * * *